US008280289B2

(12) United States Patent
Yamanaka et al.

(10) Patent No.: US 8,280,289 B2
(45) Date of Patent: Oct. 2, 2012

(54) FIXING APPARATUS AND IMAGE FORMING APPARATUS INCLUDING THE SAME

(75) Inventors: Takashi Yamanaka, Osaka (JP); Masaya Asakawa, Osaka (JP); Hirokazu Nakamura, Osaka (JP); Noriko Inoue, Osaka (JP); Masaki Amemiya, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 264 days.

(21) Appl. No.: 12/840,695

(22) Filed: Jul. 21, 2010

(65) Prior Publication Data

US 2011/0026986 A1 Feb. 3, 2011

(30) Foreign Application Priority Data

Aug. 3, 2009 (JP) ..... 2009-180685

(51) Int. Cl.
*G03G 15/20* (2006.01)

(52) U.S. Cl. ..... 399/323; 399/33; 399/122; 399/329

(58) Field of Classification Search ..... 399/33, 399/122, 320, 323, 399
See application file for complete search history.

(56) References Cited

U.S. PATENT DOCUMENTS

| | | | | |
|---|---|---|---|---|
| 7,228,096 | B2 | 6/2007 | Yamada | |
| 7,392,004 | B2 | 6/2008 | Sato et al. | |
| 7,761,043 | B2 * | 7/2010 | Park | 399/323 |
| 2002/0141792 | A1 * | 10/2002 | Nakano et al. | 399/323 |
| 2003/0016971 | A1 * | 1/2003 | Kikuchi et al. | 399/323 |
| 2003/0185580 | A1 * | 10/2003 | Furukawa | 399/33 |
| 2006/0008282 | A1 * | 1/2006 | Aratachi et al. | 399/33 |
| 2009/0297181 | A1 * | 12/2009 | Yamanaka et al. | 399/33 |

FOREIGN PATENT DOCUMENTS

| | | | |
|---|---|---|---|
| JP | 64-40870 | | 2/1989 |
| JP | 3-111872 | A | 5/1991 |
| JP | 2001022218 | A * | 1/2001 |
| JP | 2005-10218 | A | 1/2005 |
| JP | 2005-352382 | A | 12/2005 |
| JP | 2006-162996 | A | 6/2006 |
| JP | 2007-298616 | | 11/2007 |

* cited by examiner

*Primary Examiner* — David Gray
*Assistant Examiner* — Francis Gray
(74) *Attorney, Agent, or Firm* — Birch, Stewart, Kolasch & Birch, LLP

(57) ABSTRACT

An embodiment of the present invention includes a fixing member; a pressure member for pressing against the fixing member so as to form a nip region between the pressure member and the fixing member; a pressure cancellation unit for pressing the pressure member against the fixing member and for cancelling the state in which the pressure member is pressed against the fixing member; a paper detachment member for detaching paper held between the fixing member and the pressure member in the nip region from the pressure member; and a separation mechanism for cleaning the paper detachment member by separating the paper detachment member from the pressure member in conjunction with a pressure cancellation operation of the pressure cancellation unit.

8 Claims, 8 Drawing Sheets

FIXING APPARATUS AND IMAGE FORMING APPARATUS INCLUDING THE SAME

BACKGROUND OF THE INVENTION

This application claims priority under 35 U.S.C. §119(a) on Patent Application No. 2009-180685 filed in Japan on Aug. 3, 2009, the entire contents of which are herein incorporated by reference.

The present invention relates to a technology that is applied in an image forming apparatus using an electrophotographic method, such as a copying machine, a facsimile, or a printer, and more specifically to a fixing apparatus and an image forming apparatus including the fixing apparatus.

Generally, in an image forming apparatus using an electrophotographic method, an electrostatic latent image is formed on the surface of a photosensitive drum. Then, the electrostatic latent image on the surface of the photosensitive drum is developed using toner, and a toner image is thereby formed on the surface of the photosensitive drum. Thereafter, the toner image is transferred from the photosensitive drum onto recording paper, the recording paper is heated and pressed, and thus the toner image is fixed onto the recording paper.

A fixing apparatus fixes a toner image onto recording paper. In the fixing apparatus, recording paper is sandwiched in a nip region between a hot roller and a pressure roller, which form a pair, and is transported. Accordingly, the recording paper is heated and pressed by the rollers, so that toner on the recording paper is heated and melted so as to be fixed.

The method of sandwiching recording paper in the nip region between the pair of the hot roller and the pressure roller as described above is suited to speed up the fixing process because the temperature of the hot roller can be easily maintained at a constant fixing temperature.

In the fixing apparatus as described above, in order to retain the width of the nip region between the hot roller and the pressure roller and stably maintain the nip region, by covering the rollers with an elastic layer, the elastic layers of each roller are pressed against each other and deformed.

However, since the pressure between the rollers is great, when the fixing apparatus is not used and the rollers are in a stopped state for a long time, the elastic layers of the rollers are left deformed and sometimes unable to return to their original shape, thus forming a depression in the elastic layers of the rollers.

For this reason, a mechanism for applying and cancelling pressure between the hot roller and the pressure roller may be provided. That is to say, in an operating state, the hot roller and the pressure roller are pressed against each other by a biasing force of a spring, and in a non-operating state, the hot roller or the pressure roller is displaced in a direction away from the other against the biasing force of the spring to reduce the pressure between the rollers to a lower value or to zero.

For example, JP2006-162996A and JP 2005-10218A disclose such technology.

Incidentally, there is a problem in that if residual toner in solid form is sticking in a gap between an outer circumferential face of the pressure roller and a leading edge of a detachment claw, as the pressure roller rotates, the residual toner clogs up and accumulates in the gap between the detachment claw and the pressure roller, obstructs the rotation of the roller, and consequently damages the pressure roller, for example. This problem leads to dirt on paper.

SUMMARY OF THE INVENTION

The present invention has been made in view of the technical problems as described above, and it is an object thereof to provide a fixing apparatus that is capable of reducing dirt on paper and an image forming apparatus including the fixing apparatus.

In order to achieve this object, the fixing apparatus of the present invention is a fixing apparatus including a fixing member; a pressure member for pressing against the fixing member so as to form a nip region between the pressure member and the fixing member; a pressure cancellation unit for pressing the pressure member against the fixing member and for cancelling the state in which the pressure member is pressed against the fixing member; a paper detachment member for detaching paper held between the fixing member and the pressure member in the nip region from the pressure member; and a separation mechanism for cleaning the paper detachment member by separating the paper detachment member from the pressure member in conjunction with a pressure cancellation operation of the pressure cancellation unit.

In the above-described configuration, the paper detachment member is separated from the pressure member in conjunction with the pressure cancellation operation of the pressure cancellation unit, whereby the paper detachment member is cleaned. Thus, dirt on the paper detachment member can be caused to drop off. As a result, dirt on paper can be reduced.

In a first aspect, the paper detachment member includes a detachment claw that is rotatably supported on an axis in directions toward and away from the pressure member, the separation mechanism includes a stopper that regulates the range of rotation of the detachment claw in the direction toward the pressure member, and the stopper is disposed in a position where the stopper forms a separation space between the detachment claw and the pressure member when the state in which the pressure member is pressed against the fixing member is cancelled by the pressure cancellation operation of the pressure cancellation unit.

According to the above-described configuration, the stopper of the separation mechanism is disposed in the position where the stopper forms the separation space between the detachment claw and the pressure member when the state in which the pressure member is pressed against the fixing member is cancelled by the pressure cancellation operation of the pressure cancellation unit. Thus, during the pressure cancellation operation of the pressure cancellation unit, the detachment claw is received by the stopper with the separation space formed between the detachment claw and the pressure member. Therefore, dirt on a leading edge of the detachment claw can be caused to drop off with a simple configuration.

Moreover, in a second aspect, the paper detachment member includes a detachment claw that is rotatably supported on a first axis in directions toward and away from the pressure member and a spring that biases the detachment claw toward the pressure member; the separation mechanism includes a stopper that regulates the range of rotation of the detachment claw in the direction toward the pressure member, and an abutment mechanism unit for rotating the detachment claw in the direction away from the pressure member against a biasing force of the spring and subsequently rotating the detachment claw in the direction toward the pressure member by means of the biasing force of the spring, thereby causing the detachment claw to abut against the stopper, when the state in which the pressure member is pressed against the fixing member is cancelled by the pressure cancellation operation of the pressure cancellation unit; and the stopper is disposed in a position where the stopper forms a separation space between the detachment claw and the pressure member when the state in which the pressure member is pressed against the fixing member is cancelled by the pressure cancellation operation of the pressure cancellation unit.

According to the above-described configuration, when the state in which the pressure member is pressed against the fixing member is cancelled by the pressure cancellation operation of the pressure cancellation unit, the detachment claw rotates in the direction away from the pressure member against the biasing force of the spring, and subsequently, the detachment claw rotates in the direction toward the pressure member due to the biasing force of the spring to abut against the stopper. Thus, an impact can be applied to the detachment claw to clean the detachment claw. As a result, the above-described dirt removing effect is improved. At this time, the detachment claw is received by the stopper with the separation space formed between the detachment claw and the pressure member.

Specifically, the pressure cancellation unit includes a moving frame that supports the pressure member and that rotates on a second axis parallel to the first axis in directions toward and away from the fixing member, and the abutment mechanism unit includes an abutment member that is provided so as to protrude from the moving frame toward the detachment claw and that abuts against the detachment claw from a downstream side of a paper transport direction when the fixing member and the pressure member are pressed against each other. When the moving frame is rotated in the direction away from the fixing member during the pressure cancellation operation of the pressure cancellation unit, the detachment claw begins to rotate, due to an abutting force of the abutment member, in the direction away from the pressure member against the biasing force of the spring, and when the detachment claw is pushed up over the abutment member, the detachment claw is released from the abutting force of the abutment member and begins to rotate in the direction toward the pressure member due to the biasing force of the spring, and thus abuts against the stopper.

Furthermore, in a third aspect, the paper detachment member includes a detachment claw that is rotatably supported on a first axis in directions toward and away from the pressure member and a compression spring that biases the detachment claw toward the pressure member; and the separation mechanism includes a cleaning member including a cleaning member main body that is rotatably supported on a second axis parallel to the first axis in directions toward and away from the detachment claw and a spatula protruding from a leading edge portion of the cleaning member main body toward the detachment claw, and a contact mechanism unit for bringing a leading edge portion of the spatula of the cleaning member into contact with a leading edge portion of the detachment claw, by rotating a base end portion of the cleaning member main body in a direction away from the detachment claw so that the leading edge portion of the spatula of the cleaning member abuts against the detachment claw and thereby rotating the detachment claw in the direction away from the pressure member against a biasing force of the compression spring, when the state in which the pressure member is pressed against the fixing member is cancelled by the pressure cancellation operation of the pressure cancellation unit.

According to the above-described configuration, when the state in which the pressure member is pressed against the fixing member is cancelled by the pressure cancellation operation of the pressure cancellation unit, the base end portion of the cleaning member main body is rotated in the direction away from the detachment claw so that the leading edge portion of the spatula of the cleaning member abuts against the detachment claw, the detachment claw is thereby rotated in the direction away from the pressure member against the biasing force of the compression spring, and thus, the leading edge portion of the spatula of the cleaning member comes into contact with the leading edge portion of the detachment claw, so that dirt on the leading edge portion of the detachment claw can be scraped off. As a result, the above-described dirt removing effect is improved even more.

Specifically, the pressure cancellation unit includes a moving frame that supports the pressure member and that rotates on a third axis parallel to the first and the second axes in directions toward and away from the fixing member, and the contact mechanism unit includes a tension spring that causes the base end portion of the cleaning member main body to rotate in the direction away from the detachment claw so that the leading edge portion of the spatula abuts against the detachment claw, and an abutment member that is provided so as to protrude from the moving frame toward the cleaning member and that abuts against the cleaning member main body from a direction in which the abutment member pushes the cleaning member main body toward the detachment claw when the fixing member and the pressure member are pressed against each other. When the moving frame is rotated in the direction away from the fixing member during the pressure cancellation operation of the pressure cancellation unit, the abutment member begins to be temporarily separated from the cleaning member main body, and with this separation, the base end portion of the cleaning member main body is released from an abutting force of the abutment member and rotates in the direction away from the detachment claw due to a tensile force of the tension spring so that the leading edge portion of the spatula abuts against the detachment claw, and when the leading edge portion of the spatula abuts against the detachment claw, the detachment claw begins to rotate, due to an abutting force of the spatula, in the direction away from the pressure member against the biasing force of the spring, and thereafter, at a point in time when the leading edge portion of the spatula comes into contact with the leading edge portion of the detachment claw, the cleaning member main body abuts against the abutment member again.

It should be noted that in the above-described fixing apparatus, the pressure member preferably includes a cleaning member for collecting toner on the pressure member.

In this case, paper powder and residual toner that have been removed are collected by the cleaning member of the pressure member.

Moreover, an image forming apparatus according to the present invention includes the above-described fixing apparatus.

According to the present invention, a fixing apparatus that is capable of reducing dirt on paper and an image forming apparatus including the fixing apparatus can be provided.

DESCRIPTION OF THE PREFERRED EMBODIMENTS

Hereinafter, embodiments of the present invention will be described in detail based on the accompanying drawings.

First Embodiment

Configuration of Image Forming Apparatus

Figure 1:
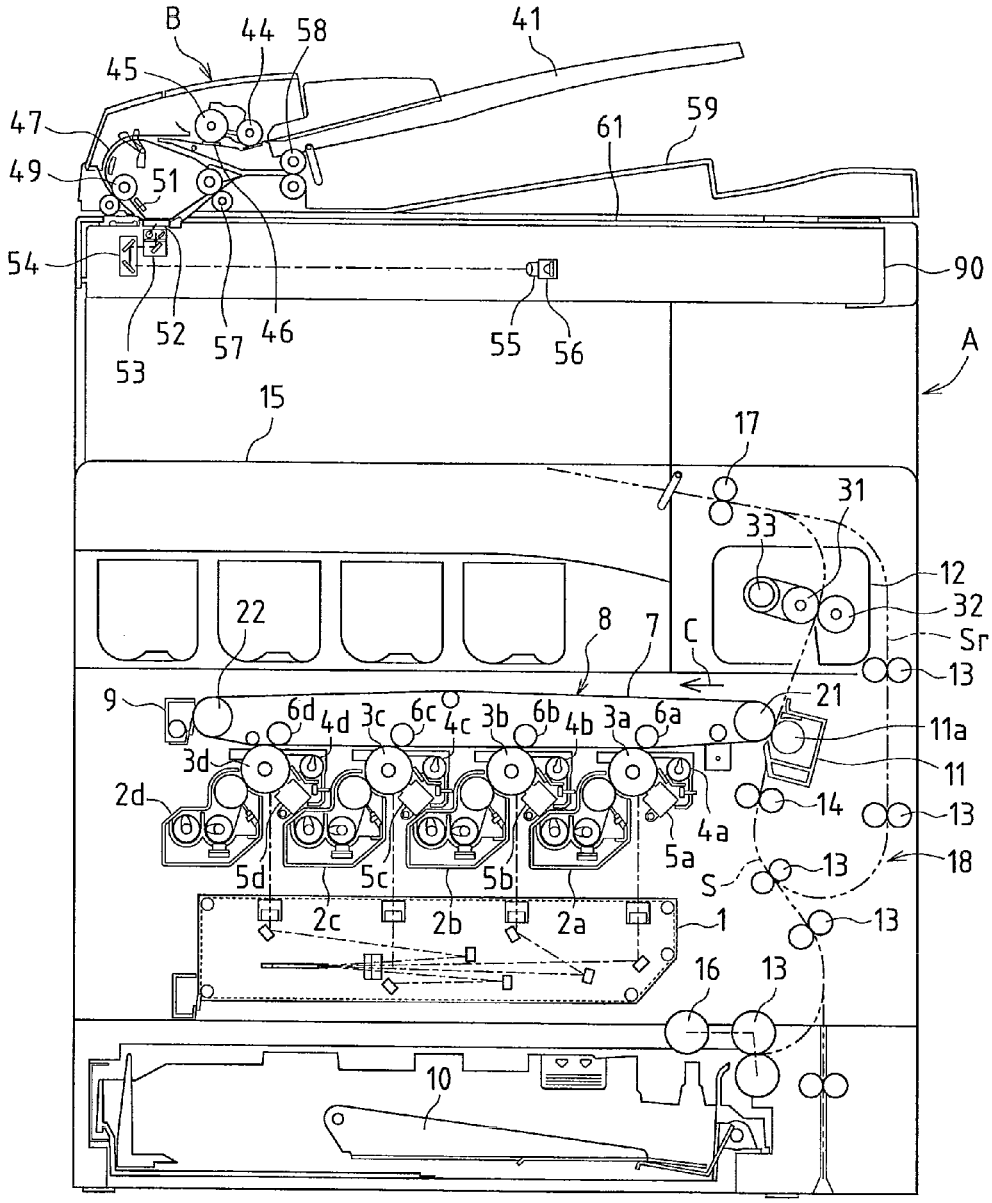
FIG. 1 is a diagram showing the configuration of an image forming apparatus to which a fixing apparatus 12 according to a first embodiment of the present invention has been applied.

FIG. 1 is a cross-sectional view showing the configuration of an image forming apparatus to which a fixing apparatus 12 according to a first embodiment of the present invention has been applied.

Referring to FIG. 1, the image forming apparatus of the present embodiment includes an original reading apparatus B, which reads an original image, and an apparatus main body A, which records and forms, on recording paper in color or in a single color, an original image read by the original reading apparatus B or an image received from outside.

In the original reading apparatus B, when originals are set on an original setting tray 41, a pickup roller 44 is pressed against the surface of the originals and rotated. Then, the originals are drawn out from the tray 41 and passed between a separation roller 45 and a separation pad 46 so as to be individually separated. Thereafter, the originals are transported to a transport path 47.

In the transport path 47, a leading edge of an original abuts against registration rollers 49 so as to be aligned parallel to the registration rollers 49. Thereafter, the original is transported by the registration rollers 49 and passes between a reading guide 51 and a reading glass 52. At this time, light from a light source of a first scanning unit 53 is irradiated onto the surface of the original via the reading glass 52, and the reflected light is made to fall incident to the first scanning unit 53 via the reading glass 52. Then, the reflected light is reflected on mirrors of the first and a second scanning units 53 and 54 and led to an imaging lens 55. An original image is formed on a CCD (Charge Coupled Device) 56 by the imaging lens 55. The CCD 56 reads the original image and outputs image data indicating the original image. Further, the original is transported by transport rollers 57 and discharged onto a discharge tray 59 via discharge rollers 58.

Also, the present image forming apparatus is capable of reading an original placed on an original stage glass 61. Specifically, the registration rollers 49, the reading guide 51, the discharge tray 59, and the like are integrated with members disposed above these elements, thus forming a cover body that is pivotally mounted in an openable and closable manner on a back side of the original reading apparatus B. When this cover body provided in the upper part is opened, the original stage glass 61 is released, and an original can be placed on the original stage glass 61. When an original is placed thereon and the cover body is closed, with the first and the second scanning units 53 and 54 being moved in the sub scanning direction, the first scanning unit 53 exposes the surface of the original on the original stage glass 61, the first and the second scanning units 53 and 54 lead light reflected on the surface of the original to the imaging lens 55, and the original image is formed on the CCD 56 by the imaging lens 55. At this time, the first and the second scanning units 53 and 54 are moved while maintaining a predetermined speed relationship therebetween. Also, the positional relationship between the first and the second scanning units 53 and 54 is always maintained in order not to change the length of the optical path of the reflected light (the surface of an original→the first and the second scanning units 53 and 54→the imaging lens 55→the CCD 56). Consequently, a state in which an original image on the CCD 56 is accurately focused on is always maintained.

The entire original image read in this manner is transmitted to the apparatus main body A of the image forming apparatus as image data, and the image is recorded onto recording paper in the apparatus main body A.

Meanwhile, the apparatus main body A of the present image forming apparatus is configured of a laser exposing apparatus 1, development apparatuses 2*a*, 2*b*, 2*c*, and 2*d*, photosensitive drums 3*a*, 3*b*, 3*c*, and 3*d*, charging units 5*a*, 5*b*, 5*c*, and 5*d*, cleaner apparatuses 4*a*, 4*b*, 4*c*, and 4*d*, an intermediate transfer belt apparatus 8, a fixing apparatus 12, a paper transport apparatus 18, a paper feed tray 10, a discharge tray 15, and the like.

Image data handled in the present image forming apparatus corresponds to a color image using black (K), cyan (C), magenta (M), and yellow (Y), or corresponds to a monochrome image using a single color (for example, black). Accordingly, four units of each of the development apparatuses 2*a*, 2*b*, 2*c*, and 2*d*, the photosensitive drums 3*a*, 3*b*, 3*c*, and 3*d*, the charging units 5*a*, 5*b*, 5*c*, and 5*d*, and the cleaner apparatuses 4*a*, 4*b*, 4*c*, and 4*d* are provided in order to form four types of latent images corresponding to each color. With each "a" corresponding to black, each "b" corresponding to cyan, each "c" corresponding to magenta, and each "d" corresponding to yellow, four image stations are configured. It should be noted that in the following description, the development apparatuses 2*a*, 2*b*, 2*c*, and 2*d*, when collectively referred to, will be called the "development apparatuses 2", the photosensitive drums 3*a*, 3*b*, 3*c*, and 3*d*, when collectively referred to, will be called the "photosensitive drums 3", the charging units 5*a*, 5*b*, 5*c*, and 5*d*, when collectively referred to, will be called the "charging units 5", and the cleaner apparatuses 4*a*, 4*b*, 4*c*, and 4*d*, when collectively referred to, will be called the "cleaner apparatuses 4".

The photosensitive drums 3 are disposed substantially in the center of the apparatus main body A.

The charging unit 5 is a charging means for uniformly charging the surface of the photosensitive drum 3 at a predetermined electric potential. Other than a contact-roller-type charging unit or a contact-brush-type charging unit, a charger-type charging unit is used as the charging unit 5.

The laser exposing apparatus 1, which is a laser scanning unit (LSU) including a laser diode and a reflection mirror, exposes the surface of the charged photosensitive drum 3 in accordance with image data and forms an electrostatic latent image on the surface thereof in accordance with the image data.

The development apparatuses 2 develop electrostatic latent images formed on the photosensitive drums 3 using toners (K), (C), (M), and (Y).

The cleaner apparatuses 4 remove and collect residual toner on the surfaces of the photosensitive drums 3 after developing and transferring images.

The intermediate transfer belt apparatus 8 is disposed above the photosensitive drums 3. The intermediate transfer belt apparatus 8 includes an intermediate transfer belt 7, an intermediate transfer belt drive roller 21, an idler roller 22, intermediate transfer rollers 6*a*, 6*b*, 6*c*, and 6*d*, and an intermediate transfer belt cleaning apparatus 9. It should be noted that the intermediate transfer rollers 6*a*, 6*b*, 6*c*, and 6*d*, when collectively referred to, will be called the "intermediate transfer rollers 6".

The intermediate transfer belt 7 is stretched across and supported by the intermediate transfer belt drive roller 21, the intermediate transfer rollers 6, the idler roller 22, and the like, which allow the intermediate transfer belt 7 to move around in the direction of arrow C.

The intermediate transfer rollers 6 are pressed against the photosensitive drums 3 via the intermediate transfer belt 7. Therefore, a transfer bias for transferring toner images on the photosensitive drums 3 onto the intermediate transfer belt 7 is applied to the intermediate transfer rollers 6.

The intermediate transfer belt 7 is provided so as to be in contact with the photosensitive drums 3*a*, 3*b*, 3*c*, and 3*d*. A toner image on the surfaces of the photosensitive drums 3*a*, 3*b*, 3*c*, and 3*d* is sequentially superimposed and transferred onto the intermediate transfer belt 7 so as to form a color toner image (toner images of each color described above). This intermediate transfer belt 7 is formed as an endless belt, using a film having a thickness of approximately 100 μm to 150 μm.

A toner image is transferred from the photosensitive drums 3 onto the intermediate transfer belt 7 by the intermediate transfer rollers 6, which are pressed against the inner face of the intermediate transfer belt 7. In order to transfer the toner images, a high voltage transfer bias (high voltage with the opposite polarity (+) to the charge polarity (−) of the toner) is applied to the intermediate transfer rollers 6.

The intermediate transfer rollers 6 use a shaft made of a metal (stainless steel, for example) with a diameter of 8 to 10 mm as a base, and the surface thereof is covered with conductive elastic material (such as EPDM and urethane foam, for example). With this conductive elastic material, it is possible to uniformly apply a high voltage to recording paper.

As described above, the toner images on the surfaces of the photosensitive drums 3*a*, 3*b*, 3*c*, and 3*d* are layered on the intermediate transfer belt 7 and become a color toner image indicated by image data. The toner images of each color layered as described above are transported together with the intermediate transfer belt 7 and transferred onto the recording paper by a second transfer apparatus 11, which is in contact with the intermediate transfer belt 7.

The intermediate transfer belt 7 and a transfer roller 11*a* of the second transfer apparatus 11 are pressed against each other so as to form a nip region. Further, a voltage (high voltage with the opposite polarity (+) to the charge polarity (−) of the toner) for transferring toner images of each color on the intermediate transfer belt 7 onto recording paper is applied to the transfer roller 11*a* of the second transfer apparatus 11. Furthermore, in order to obtain the nip region constantly, either one of the transfer roller 11*a* of the second transfer apparatus 11 and the intermediate transfer belt drive roller 21 is made of a hard material (metal or the like), and the other is a roller made of a soft material, such as an elastic roller (elastic rubber roller, foam resin roller, and the like).

There is a case in which the second transfer apparatus 11 does not completely transfer a toner image on the intermediate transfer belt 7 onto recording paper, thus leaving toner on the intermediate transfer belt 7, so that the residual toner causes color toners to be mixed in the following processing. For this reason, the intermediate transfer belt cleaning apparatus 9 removes and collects residual toner.

The intermediate transfer belt cleaning apparatus 9 includes, for example, a cleaning blade as a cleaning member that is in contact with the intermediate transfer belt 7, and the intermediate transfer belt 7 is supported by the idler roller 22 from the inner face in a position where the cleaning blade is in contact with the intermediate transfer belt 7.

The paper feed tray 10 is a tray for storing recording paper and is provided in the lower part of an image forming unit of the apparatus main body A. Also, the discharge tray 15 provided in the upper part of the image forming unit is a tray on which printed recording paper is to be placed facedown.

Further, the apparatus main body A is provided with the paper transport apparatus 18 for conveying recording paper on the paper feed tray 10 to the discharge tray 15 through the second transfer apparatus 11 and the fixing apparatus 12. The paper transport apparatus 18 has an S-shaped paper transport path S, and a pickup roller 16, registration rollers 14, the fixing apparatus 12, transport rollers 13, discharge rollers 17, and the like are disposed along the paper transport path S.

The pickup roller 16 is a draw-in roller that is provided on the edge portion of the paper feed tray 10 and that supplies pieces of recording paper one-by-one from the paper feed tray 10 to the paper transport path S.

The transport rollers 13 are small rollers for promoting and assisting transportation of recording paper, and are provided in a plurality of positions along the paper transport path S.

The registration rollers 14 temporarily stop transported recording paper, align the leading edge of the recording paper, and then transport the recording paper with good timing matched with the rotation of the photosensitive drums 3 and the intermediate transfer belt 7 so that a color toner image on the intermediate transfer belt 7 is transferred onto the recording paper in the nip region between the intermediate transfer belt 7 and the second transfer apparatus 11.

The fixing apparatus 12 receives recording paper on which a toner image has been transferred, transports the recording paper while sandwiching the recording paper in a nip region between a hot roller 31 and a pressure roller 32, and applies heat and pressure to the recording paper to fix the toner image on the recording paper.

The recording paper on which toner images of each color have been fixed is discharged by the discharge rollers 17 onto the discharge tray 15.

Note that in the present image forming apparatus, it is also possible to form a monochrome image using only a single image forming station and transfer the monochrome image onto the intermediate transfer belt 7 of the intermediate transfer belt apparatus 8. The monochrome image is transferred onto recording paper from the intermediate transfer belt 7 and fixed onto the recording paper, similarly to a color image.

Further, when printing not only the front face of the recording paper, but both faces, after an image on the front face of the recording paper has been fixed by the fixing apparatus 12, the discharge rollers 17 are stopped and then rotated in reverse while transporting the recording paper by the discharge rollers 17 on the paper transport path S, thereby causing the recording paper to pass through a reverse path Sr. After the front and back of the recording paper are reversed, the recording paper is led to the registration rollers 14. Similarly to the case of printing the front face of the recording paper, an image is recorded and fixed on the back face of the recording paper, and the recording paper is discharged onto the discharge tray 15.

Configuration of Fixing Apparatus

Figure 2:
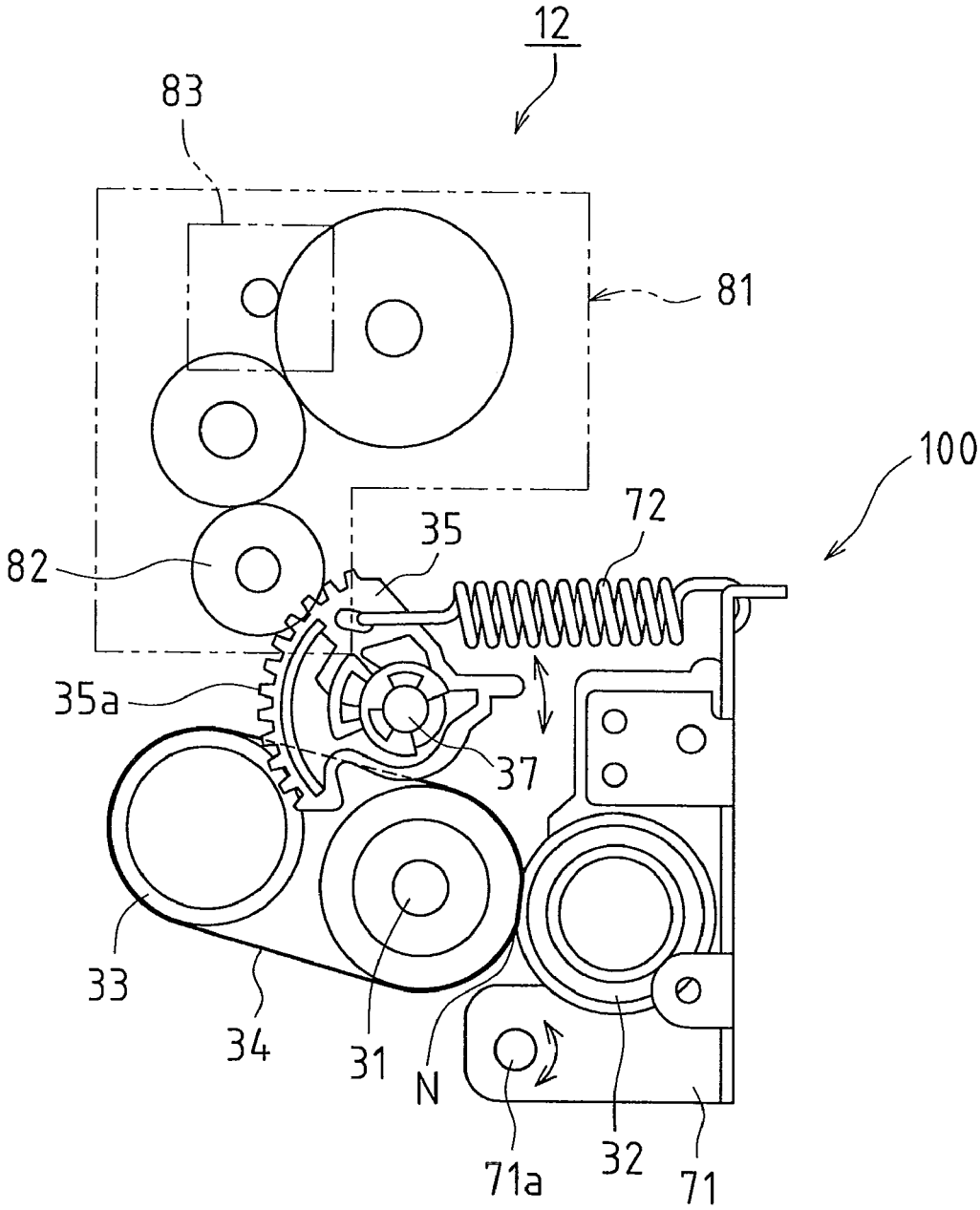
FIG. 2 is a diagram showing a pressure applied state of a hot roller 31 and a pressure roller 32 of the fixing apparatus 12.
Figure 3:
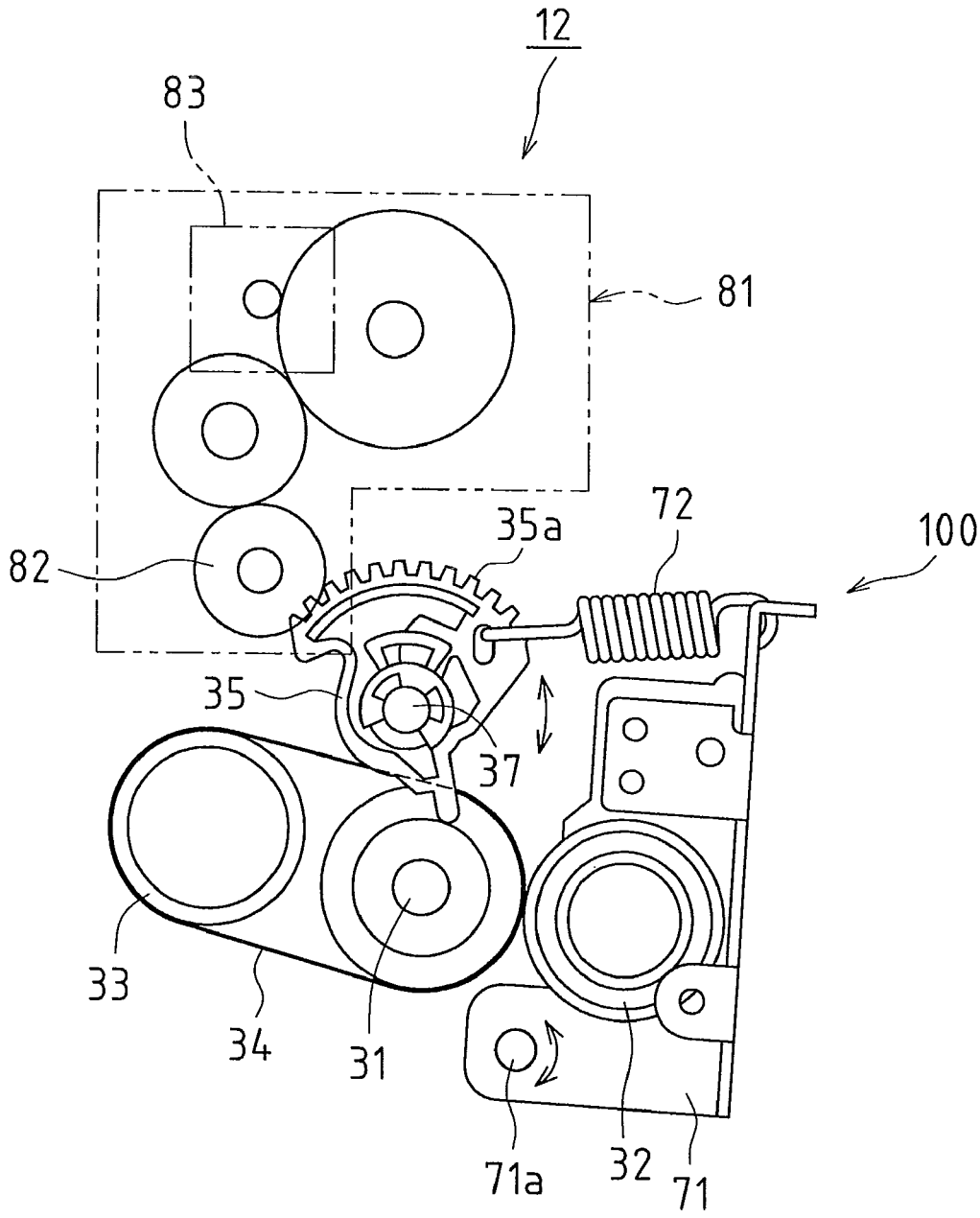
FIG. 3 is a diagram showing a pressure cancelled state of the hot roller 31 and the pressure roller 32 of the fixing apparatus 12.

FIG. 2 is a diagram showing a pressure applied state in which the hot roller 31 and the pressure roller 32 of the fixing apparatus 12 are pressed against each other, and FIG. 3 is a diagram showing a pressure cancelled state in which the pressure between the hot roller 31 and the pressure roller 32 of the fixing apparatus 12 is cancelled.

Referring to FIGS. 2 and 3, the above-described fixing apparatus 12 includes the hot roller 31, the pressure roller 32, a hot assist roller 33, and an endless, fixing belt 34 that is fitted over the hot roller 31 and the hot assist roller 33 and stretched between them, and the hot roller 31 and the pressure roller 32 are pressed against each other via the fixing belt 34 so as to form a nip region N between the rollers 31 and 32. In this manner, according to the present embodiment, a fixing member is configured of the hot roller 31, the hot assist roller 33, and the fixing belt 34. Moreover, a pressure member is configured of the pressure roller 32.

In a state in which this fixing apparatus 12 is installed in the apparatus main body A of the image forming apparatus, a gear (not shown) of a drive mechanism on the apparatus main body A side meshes with a gear (not shown) of a shaft of the hot roller 31, so that a rotatively driving force from the drive mechanism on the apparatus main body A side is transmitted to the shaft of the hot roller 31, and the hot roller 31 is driven to rotate. With this rotation of the hot roller 31, the hot assist roller 33 and the fixing belt 34 rotate in the same direction as the hot roller 31, causing the pressure roller 32 to be idly rotated. Recoding paper is transported while being sandwiched in the nip region N between the rollers 31 and 32 and is thus heated and pressed. As a result, a toner image on the recording paper is melted, mixed, and pressed so as to be thermally fixed onto the recording paper.

The hot roller 31 is a roller having a three-layer structure in which an elastic layer is provided on an outer surface of a core metal and a mold release layer is formed on an outer surface of the elastic layer. For example, a metal such as iron, stainless steel, aluminum, and copper, or an alloy of these is used for the core metal. Furthermore, a silicon rubber is used for the elastic layer, and a fluorocarbon resin, such as PFA (tetrafluoroethylene-perfluoroalkylvinylether copolymer) and PTFE (polytetrafluoroethylene), is used for the mold release layer.

A heater lamp (halogen lamp), which is a heat source for heating the hot roller 31, is provided inside the hot roller 31 (inside the core metal).

A heat source is also provided in the hot assist roller 33, and the heat of the hot assist roller 33 is conducted by the fixing belt 34 to the hot roller 31 to supplement the amount of heat of the hot roller 31.

Similar to the hot roller 31, the pressure roller 32 is a roller that also has a three-layer structure in which a core metal made of a metal such as iron, stainless steel, aluminum, and copper, or an alloy of these, an elastic layer made of a silicon rubber or the like on the surface of the core metal, and further still a mold release layer made of a material such as PFA and PTFE on the elastic layer are provided.

Since the hot roller 31 and the pressure roller 32 are provided with the elastic layers as described above and the rollers 31 and 32 are pressed against each other, the width of the nip region N between the rollers 31 and 32 can be broadened.

However, when the fixing apparatus 12 is not used, and the rollers 31 and 32 are in a stopped state for a long time, the elastic layers of the rollers 31 and 32 are kept deformed and may not return to the original shapes thereof, so that a depression may be formed in the elastic layers of the rollers 31 and 32.

Moreover, also when the fixing apparatus 12 is removed from the apparatus main body A of the image forming apparatus for maintenance, and the rollers 31 and 32 are left pressed against each other, a depression may be formed in the elastic layers of the rollers 31 and 32 as well.

In view of these issues, in this fixing apparatus 12, when the fixing apparatus 12 is stopped, and when the fixing apparatus 12 is removed from the image forming apparatus, the pressure applied state of the rollers 31 and 32 is cancelled in order to avoid the elastic layers of the rollers 31 and 32 from being left deformed. For this purpose, in the present embodiment, the fixing apparatus 12 includes a pressure cancellation unit 100. The configuration of this pressure cancellation unit 100 will be described below.

Configuration of Pressure Cancellation Unit

Figure 4:
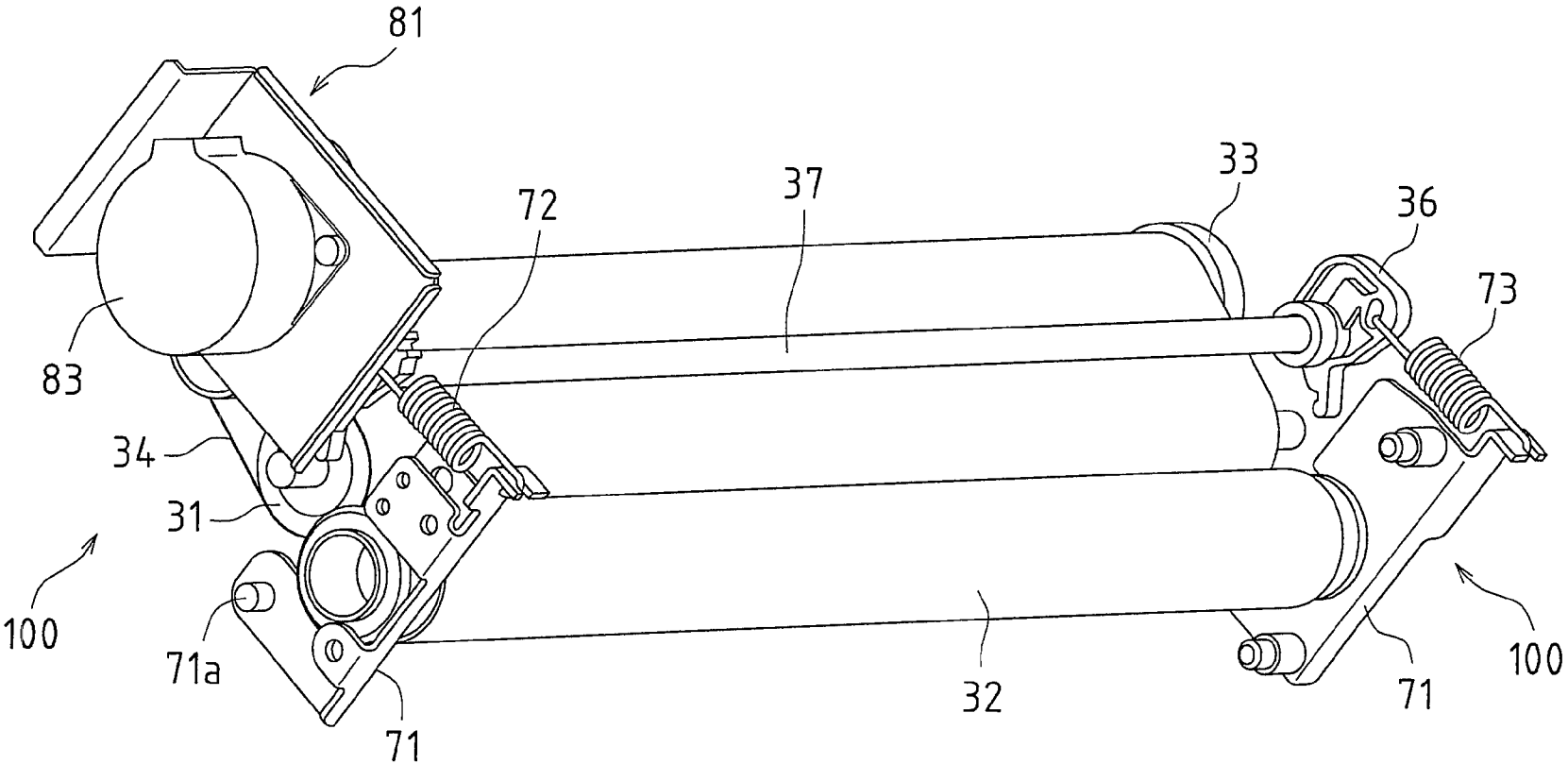
FIG. 4 is a perspective view showing the pressure cancelled state of the hot roller 31 and the pressure roller 32 of the fixing apparatus 12 as seen from one side of the rollers 31 and 32.
Figure 5:
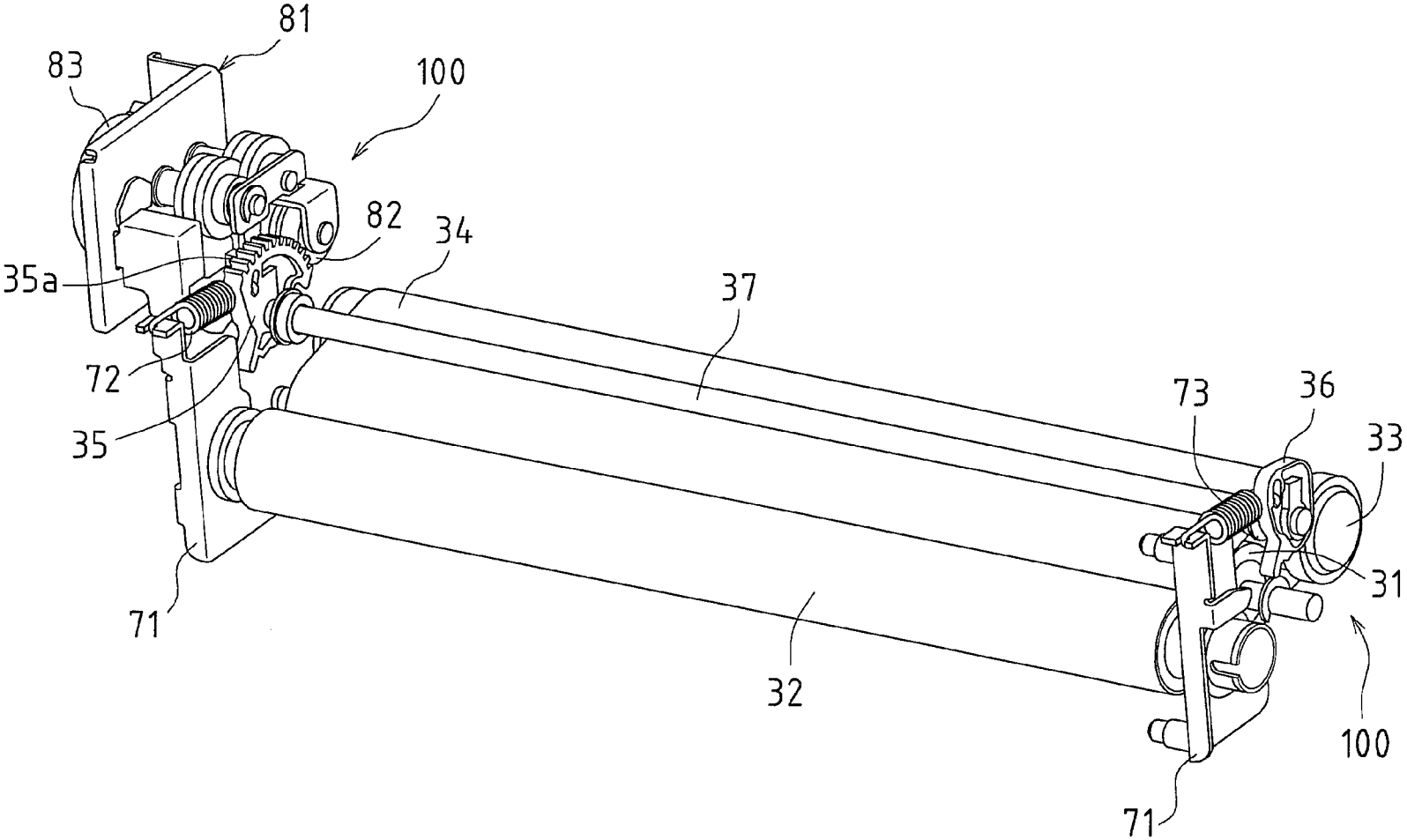
FIG. 5 is a perspective view showing the pressure cancelled state of the hot roller 31 and the pressure roller 32 of the fixing apparatus 12 as seen from the other side of the rollers 31 and 32.

FIGS. 4 and 5 are perspective views showing a pressure cancelled state of the hot roller 31 and the pressure roller 32 of the fixing apparatus 12 as seen from opposite sides of the rollers 31 and 32. It should be noted that the pressure applied state is a state in which the pressure between the rollers 31 and 32 is set to such a high value that fixing onto recording paper can be successfully performed, and the pressure cancelled state is a state in which the pressure between the rollers 31 and 32 is low or zero, and includes a state in which the rollers 31 and 32 are in slight contact with each other.

As shown in FIGS. 2 to 5, both ends of the shaft of the hot roller 31 are rotatably supported on a stationary frame (not shown) of the fixing apparatus 12, and their supporting positions are fixed. Similarly, both ends of a shaft of the hot assist roller 33 also are rotatably supported on the stationary frame of the fixing apparatus 12, and their supporting positions are fixed. The fixing belt 34 is fitted over and stretched between the hot roller 31 and the hot assist roller 33.

The pressure cancellation unit 100 is a section for pressing the pressure roller 32 against the hot roller 31 and also cancelling the pressure applied state, and includes an approximately fan-shaped gear member 35, a rotary member 36, a pair of right and left moving frames 71 provided on opposite sides of the fixing apparatus 12, coil springs 72 and 73, a drive mechanism 81, and the like.

The gear member 35 and the rotary member 36 are fixed to both ends of a single shaft 37. The both ends of this shaft 37 are rotatably supported on the stationary frame of the fixing apparatus 12, whereby the supporting positions of the gear member 35 and the rotary member 36 are fixed. Therefore, the gear member 35 and the rotary member 36 are provided on the stationary frame of the fixing apparatus 12.

Both ends of a shaft of the pressure roller 32 are axially supported between the paired two moving frames 71. These moving frames 71 are rotatably supported on a shaft 71*a* in directions toward and away from the hot roller 31. As these moving frames 71 rotate, the pressure roller 32 also moves toward and away from the hot roller 31 in conjunction with the moving frames 71.

The coil spring 72 extends between the gear member 35 and the moving frame 71 with its hooks at both ends respectively engaged with the gear member 35 axially supported on the stationary frame and with the moving frame 71. Similarly, the coil spring 73 also extends between the rotary member 36 and the moving frame 71 with its hooks at both ends respectively engaged with the rotary member 36 axially supported on the stationary frame and with the moving frame 71. These coil springs 72 and 73 are for pressing the pressure roller 32 against the hot roller 31 by pulling the moving frames 71 toward the stationary frame side by the tension of the coil springs 72 and 73.

A gear 35*a* is formed in part of a circumferential face of the gear member 35 axially supported on the stationary frame. In a state in which the fixing apparatus 12 is installed in the apparatus main body A of the image forming apparatus, a gear 82 of the drive mechanism 81 on the apparatus main body A side meshes with the gear 35*a* in part of the circumferential face of the gear member 35.

The drive mechanism 81 on the apparatus main body A side includes the gear 82, a driving motor 83, and a gear unit including a power transmission path from the driving motor 83 to the gear 82 and an electromagnetic clutch for connecting and disconnecting the power transmission path. When the electromagnetic clutch is on, the power transmission path of the gear unit is connected, and rotation of an output shaft of the driving motor 83 is transmitted to the gear member 35 via the power transmission path of the gear unit and the gear 82. That is to say, the gear member 35 axially supported on the stationary frame of the fixing apparatus 12 is driven to rotate by the drive mechanism 81 on the apparatus main body A side of the image forming apparatus. When the electromagnetic clutch is off, the power transmission path of the gear unit is disconnected, and the gear member 35 is allowed to rotate freely.

Furthermore, even when the fixing apparatus 12 is removed from the apparatus main body A of the image forming apparatus, the gear member 35 of the fixing apparatus 12 is separated from the gear 82 of the drive mechanism 81 on the apparatus main body A side, so that the gear member 35 is allowed to rotate freely.

Here, in the state in which the fixing apparatus 12 is installed in the apparatus main body A of the image forming apparatus, if a power supply of the image forming apparatus is turned off, the electromagnetic clutch of the drive mechanism 81 is turned off, so that the power transmission path of the gear unit of the drive mechanism 81 is disconnected, and the gear 82 of the drive mechanism 81 is allowed to rotate freely. Thus, the gear member 35 meshing with the gear 82 also is allowed to rotate freely. Accordingly, the rotary member 36, which is axially supported on the same shaft 37 as the gear member 35, is also allowed to rotate freely. At this time, as shown in FIGS. 3, 4, and 5, the gear member 35 and the rotary member 36 rotate under their own weight in the clockwise direction, so that the coil spring 72 between the gear member 35 and the moving frame 71 and the coil spring 73 between the rotary member 36 and the moving frame 71 are compressed to their minimum lengths. Therefore, the tension of each of the coil springs 72 and 73 is not generated, and the pressure roller 32 is in no way pressed against the hot roller 31 by the tension of each of the coil springs 72 and 73. Thus, the rollers 31 and 32 are in the pressure cancelled state. In this pressure cancelled state, the rollers 31 and 32 are not pressed against each other while being kept stopped, and therefore, a depression is in no way formed in the elastic layers of the rollers 31 and 32.

Next, if the power supply of the image forming apparatus is turned on, the electromagnetic clutch of the drive mechanism 81 is turned on, and the power transmission path of the gear unit of the drive mechanism 81 is connected. At this time, if the driving motor 83 of the drive mechanism 81 is actuated, the rotation of the output shaft of the driving motor 83 is transmitted to the gear member 35 via the gear unit and the gear 82, and as shown in FIG. 2, the gear member 35 is rotated counterclockwise, so that the rotary member 36, which is axially supported on the same shaft 37 as the gear member 35, also rotates in the same direction. As the gear member 35 and the rotary member 36 rotate counterclockwise, the coil spring 72 between the gear member 35 and the moving frame 71 and the coil spring 73 between the rotary member 36 and the moving frame 71 are stretched, and accordingly the tension of each of the coil springs 72 and 73 is generated. Due to the tension of the coil springs 72 and 73, the pressure roller 32 is pressed against the hot roller 31, and thus, the rollers 31 and 32 are in the pressure applied state.

The larger the angle to which the gear member 35 and the rotary member 36 rotate counterclockwise, the longer the amount by which the coil springs 72 and 73 are stretched, the higher the tension of each of the coil springs 72 and 73, and the greater the pressure between the rollers 31 and 32. Therefore, the pressure between the rollers 31 and 32 can be adjusted by controlling the angle to which the gear member 35 and the rotary member 36 rotate counterclockwise.

Thus, when the image forming apparatus and the fixing apparatus 12 are in operation, the pressure between the rollers 31 and 32 can be appropriately adjusted.

Next, if the power supply of the image forming apparatus is turned off again, as described above, the electromagnetic clutch of the drive mechanism 81 is turned off, and the power transmission path of the gear unit of the drive mechanism 81 is disconnected, so that the gear 82 of the drive mechanism 81 is allowed to rotate freely, and the gear member 35 and the rotary member 36 are also allowed to rotate freely. Thus, as shown in FIG. 3, the gear member 35 and the rotary member 36 rotate under their own weight in the clockwise direction, the coil springs 72 and 73 are compressed to their minimum lengths, and therefore the tension of each of the coil springs 72 and 73 is not generated. Consequently, the rollers 31 and 32 are in the pressure cancelled state.

Then, in this pressure cancelled state, if the fixing apparatus 12 is removed from the apparatus main body A of the image forming apparatus, even though the gear member 35 of the fixing apparatus 12 is disengaged from the gear 82 of the drive mechanism 81, the gear member 35 and the rotary member 36 remain freely rotatable, the coil springs 72 and 73 also remain compressed, and thus the pressure cancelled state of the rollers 31 and 32 is maintained. Therefore, when the fixing apparatus 12 has been removed for maintenance and the like, the rollers 31 and 32 are not pressed against each other, and a depression is in no way formed in the elastic layers of the rollers 31 and 32.

Moreover, even if the power supply of the image forming apparatus is on, when a door of the apparatus main body A is opened for removal of the fixing apparatus 12 from the apparatus main body A of the image forming apparatus, the electromagnetic clutch of the drive mechanism 81 is turned off in conjunction with the opening operation of the door, and the power transmission path of the gear unit of the drive mechanism 81 is disconnected. For example, a sensor detects the opening operation of the door, and in response to a detection output of this sensor, the electromagnetic clutch of the drive mechanism 81 is turned off. Even in this case, the gear member 35 and the rotary member 36 are allowed to rotate freely, the coil springs 72 and 73 are compressed to their minimum lengths, and consequently, the rollers 31 and 32 are in the pressure cancelled state. Thus, even if the fixing apparatus 12 is removed, a depression is not formed in the elastic layers of the rollers 31 and 32.

That is to say, even if the power supply of the image forming apparatus is on, the electromagnetic clutch of the drive mechanism 81 is turned off when the door of the apparatus main body A is opened for removal of the fixing apparatus 12, so that the gear member 35 and the rotary member 36 are allowed to rotate freely, the coil springs 72 and 73 are compressed to their minimum lengths, and consequently, the rollers 31 and 32 are in the pressure cancelled state. Thus, even if the fixing apparatus 12 is removed, a depression is not formed in the elastic layers of the rollers 31 and 32.

Incidentally, there is a problem in that if residual toner in solid form is sticking in the gap between the outer circumferential face of the pressure roller 32 and a leading edge of a paper detachment member 200 (see FIGS. 6A and 6B), as the pressure roller 32 rotates, the solid toner clogs up and accumulates in the gap between the paper detachment member 200 and the pressure roller 32, obstructs the rotation of the roller, and consequently, causes problems such as damage to the pressure roller 32. This problem leads to dirt on paper.

In order to prevent this situation, in the present embodiment, a separation mechanism 300 is provided for cleaning the paper detachment member 200 by separating the paper detachment member 200 from the pressure roller 32 in conjunction with the pressure cancellation operation of the above-described pressure cancellation unit 100. The configuration of this separation mechanism 300 will be described below.

Configuration of Separation Mechanism

Figure 6A:
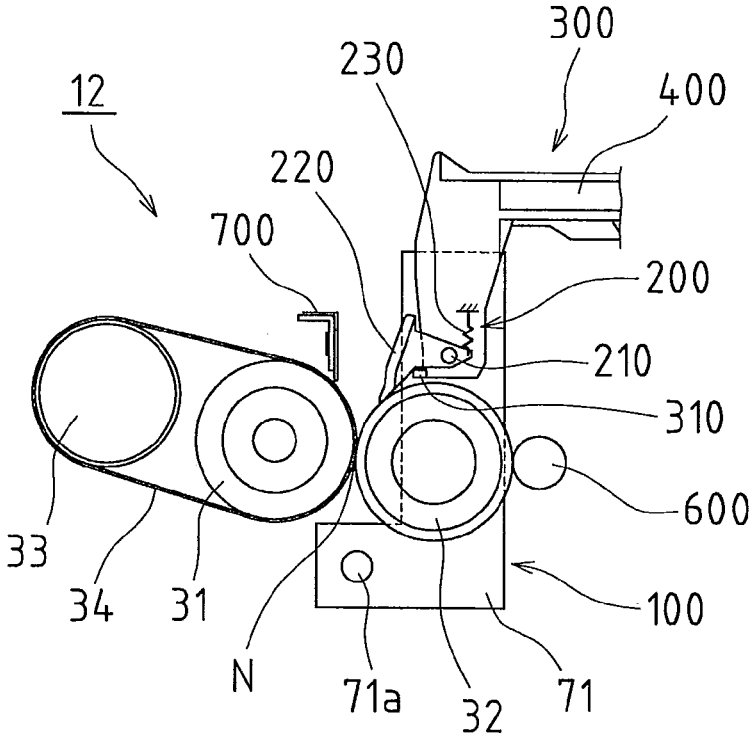
FIGS. 6A and 6B are diagrams for explaining a dirt removing operation of a paper detachment member 200 of the fixing apparatus 12.
Figure 6B:
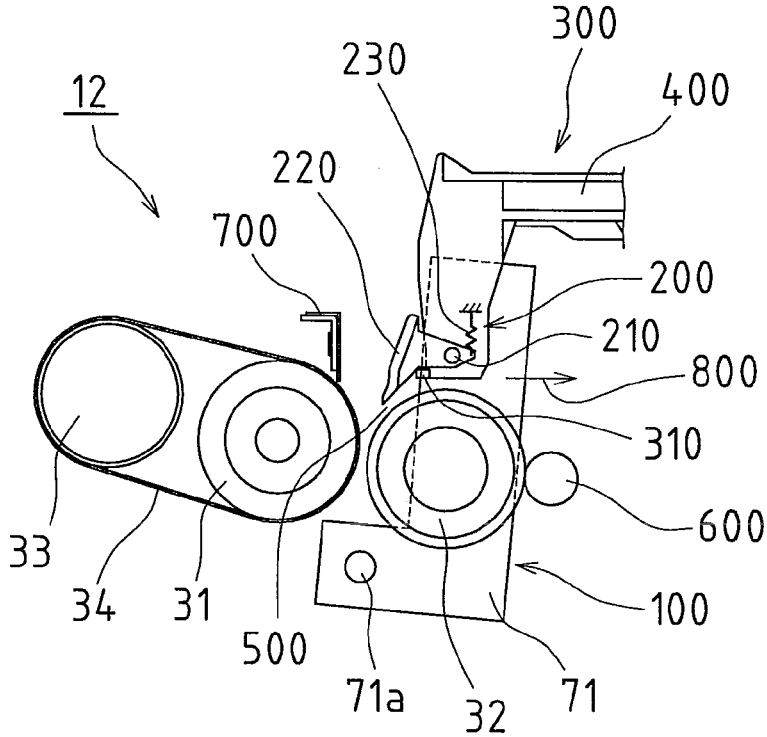

FIGS. 6A and 6B are diagrams for explaining a dirt removing operation of the paper detachment member 200 of the fixing apparatus 12.

Referring to FIGS. 6A and 6B, the configuration of the paper detachment member 200 will be described first, followed by a description of the configuration of the separation mechanism 300.

The paper detachment member 200 is a member for detaching recording paper sandwiched between the hot roller 31 and the pressure roller 32 in the above-described nip region N from the pressure roller 32 in order to prevent the recoding paper from winding around the pressure roller 32, and is configured of a detachment claw 220 that is rotatably supported on a shaft 210 in directions toward and away from the pressure roller 32, and a compression spring 230 that biases this detachment claw 220 toward the pressure roller 32. End portions of the shaft 210 that serves as a rotation supporting point of the detachment claw 220 are axially supported on a paper guide 400. It should be noted that this shaft 210 is parallel to the shaft 71*a*, which serves as a rotation supporting point of the moving frames 71.

The separation mechanism 300 includes a stopper 310 that regulates the range of rotation of the detachment claw 220 in the direction toward the pressure roller 32. This stopper 310 is disposed in a lower end portion of the paper guide 400, in a position where the stopper 310 forms a separation space 500 between the detachment claw 220 and the pressure roller 32 when the pressure applied state in which the pressure roller 32 is pressed against the hot roller 31 is cancelled by the pressure cancellation operation of the pressure cancellation unit 100 (when the pressure roller 32 is separated from the fixing belt 34 as the moving frames 71 rotate on the shaft 71*a* in a direction 800 away from the hot roller 31, and the pressure exerted on the hot roller 31 by the pressure roller 32 is removed).

Moreover, in the present fixing apparatus 12, a cleaning roller 600 for collecting residual toner sticking to the outer circumferential face of the pressure roller 32 is pressed against a lower portion of the pressure roller 32.

Furthermore, in the present fixing apparatus 12, a cleaning blade 700 is provided above the fixing belt 34, and this cleaning blade 700 removes residual toner on the fixing belt 34.

Operation

In the present fixing apparatus 12, when the hot roller 31 and the pressure roller 32 are pressed against each other with the fixing belt 34 sandwiched between them, as shown in FIG. 6A, the detachment claw 220 of the paper detachment member 200 abuts against the outer circumferential face of the pressure roller 32. From this state, as shown in FIG. 6B, if the moving frames 71 of the pressure cancellation unit 100 are rotated on the shaft 71*a* in the direction 800 away from the hot roller 31 so that the pressure roller 32 is separated from the fixing belt 34 and the pressure exerted on the hot roller 31 by the pressure roller 32 is removed, the detachment claw 220 of the paper detachment member 200 is separated from the pressure roller 32 in conjunction with this rotation. Thus, the detachment claw 220 is cleaned.

At this time, since the stopper 310 of the separation mechanism 300 is disposed in the position where the stopper 310 forms the separation space 500 between the detachment claw 220 and the pressure roller 32 when the pressure applied state in which the pressure roller 32 is pressed against the hot roller 31 is cancelled by the pressure cancellation operation of the pressure cancellation unit 100, during the pressure cancellation operation of the pressure cancellation unit 100, the detachment claw 220 is received by the stopper 310 with the separation space 500 formed between the detachment claw 220 and the pressure roller 32.

Paper powder and residual toner removed from the detachment claw 220 in the above-described manner are collected by the cleaning roller 600 pressed against the pressure roller 32.

Effects

According to the present embodiment, the following effects can be obtained.

(1) Since the detachment claw 220 of the paper detachment member 200 is separated from the pressure roller 32 in conjunction with the pressure cancellation operation of the pressure cancellation unit 100, whereby the detachment claw 220 is cleaned, dirt on a leading edge of the detachment claw 220 can be caused to drop off. As a result, dirt on recording paper can be reduced.

(2) The detachment claw 220 of the paper detachment member 200 is separated from the pressure roller 32 in conjunction with the pressure cancellation operation of the pressure cancellation unit 100, and at this time, the detachment claw 220 is received by the stopper 310 with the separation space 500 formed between the detachment claw 220 and the pressure roller 32. Therefore, dirt on the leading edge of the detachment claw 220 can be caused to drop off with a simple configuration.

(3) Since the cleaning roller 600 for collecting residual toner sticking to the outer circumferential face of the pressure roller 32 is pressed against the lower portion of the pressure roller 32, paper powder and residual toner removed from the detachment claw 220 can be collected by the cleaning roller 600 pressed against the pressure roller 32.

Second Embodiment

Figure 7A:
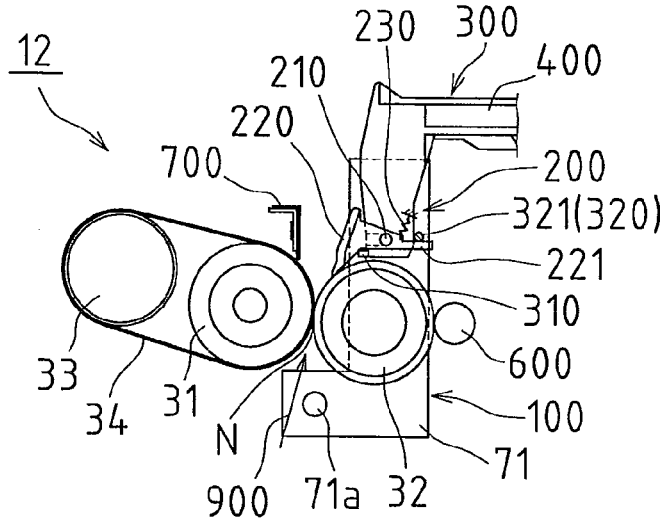
FIGS. 7A to 7C are diagrams for explaining a dirt removing operation of the paper detachment member 200 of the fixing apparatus 12 according to a second embodiment of the present invention.
Figure 7B:
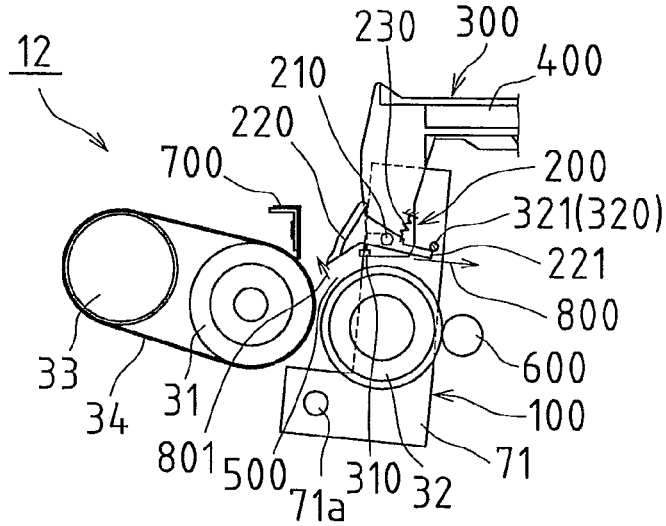
Figure 7C:
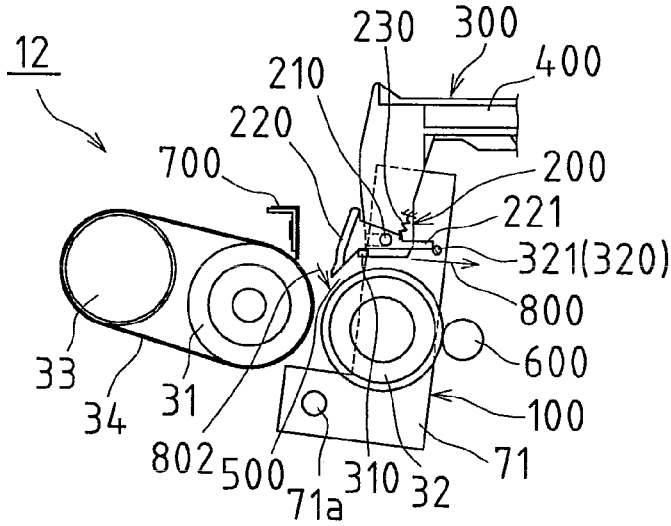

FIGS. 7A to 7C are diagrams for explaining a dirt removing operation of the paper detachment member 200 of the fixing apparatus 12 according to a second embodiment of the present invention.

Referring to FIGS. 7A to 7C, a feature of the present embodiment is that the shape of the detachment claw 220 of the paper detachment member 200 is designed with some contrivance, and when the detachment claw 220 of the paper detachment member 200 is separated from the pressure roller 32 in conjunction with the pressure cancellation operation of the above-described pressure cancellation unit 100, an impact is applied to the detachment claw 220 to dust the detachment claw 220, thereby removing paper powder and residual toner sticking to the detachment claw 220. The other configurations are the same as those of the first embodiment.

Therefore, the detachment claw 220 has an arm portion 221 extended from a base end portion thereof and forms a lever shape.

Meanwhile, the separation mechanism 300 includes, in addition to the above-described stopper 310, an abutment mechanism unit 320 for rotating the detachment claw 220 in a direction 801 away from the pressure roller 32 against the biasing force of the compression spring 230 and subsequently rotating the detachment claw 220 in a direction 802 toward the pressure roller 32 by means of the biasing force of the compression spring 230, thereby causing the detachment claw 220 to abut against the stopper 310, when the pressure applied state in which the pressure roller 32 is pressed against the hot roller 31 is cancelled by the pressure cancellation operation of the pressure cancellation unit 100 (when the pressure roller 32 is separated from the fixing belt 34 as the moving frames 71 rotate on the shaft 71*a* in the direction 800 away from the hot roller 31, and the pressure exerted on the hot roller 31 by the pressure roller 32 is removed).

The abutment mechanism unit 320 is provided so as to protrude from the moving frame 71 toward the detachment claw 220, and is configured of an abutment shaft 321 that abuts against the arm portion 221 of the detachment claw 220 from the downstream side (the rear side) of a paper transport direction 900 when the hot roller 31 and the pressure roller 32 are pressed against each other with the fixing belt 34 sandwiched between them.

Operation

In the present fixing apparatus 12, when the hot roller 31 and the pressure roller 32 are pressed against each other with the fixing belt 34 sandwiched between them, as shown in FIG. 7A, the detachment claw 220 of the paper detachment member 200 abuts against the outer circumferential face of the pressure roller 32. From this state, as shown in FIGS. 7B and 7C, if the moving frames 71 of the pressure cancellation unit 100 are rotated on the shaft 71*a* in the direction 800 away from the hot roller 31 so that the pressure roller 32 is separated from the fixing belt 34 and the pressure exerted on the hot roller 31 by the pressure roller 32 is removed, the detachment claw 220 of the paper detachment member 200 is separated from the pressure roller 32 in conjunction with this rotation.

At this time, as shown in FIG. 7B, the detachment claw 220 rotates on the shaft 210 in the direction 801 away from the pressure roller 32 against the biasing force of the compression spring 230, and subsequently, as shown in FIG. 7C, the detachment claw 220 rotates on the shaft 210 in the direction 802 toward the pressure roller 32 due to the biasing force of the compression spring 230 to abut against the stopper 310.

More specifically, if the moving frames 71 are rotated on the shaft 71*a* in the direction 800 away from the hot roller 31 (the fixing belt 34) during the pressure cancellation operation of the pressure cancellation unit 100, the abutment shaft 321 begins to push the arm portion 221 of the detachment claw 220, so that the pressure (abutting force) of the abutment shaft 321 causes the detachment claw 220 to rotate on the shaft 210 in the direction 801 away from the pressure roller 32 against the biasing force of the compression spring 230 (see FIG. 7B). Then, when the arm portion 221 of the detachment claw 220 is pushed up over the abutment shaft 321, the detachment claw 220 is released from the pressure (abutting force) of the abutment shaft 321 and begins to rotate on the shaft 210 in the direction 802 toward the pressure roller 32 due to the biasing force of the compression spring 230, and thus abuts against the stopper 310 (see FIG. 7C).

At this time, the detachment claw 220 is received by the stopper 310 with the separation space 500 formed between the detachment claw 220 and the pressure roller 32.

Effects

According to the present embodiment, the same effect as (3) of the first embodiment can be obtained, and also the following effect can be obtained.

When the pressure applied state in which the pressure roller 32 is pressed against the hot roller 31 is cancelled by the pressure cancellation operation of the pressure cancellation unit 100, the detachment claw 220 rotates in the direction 801 away from the pressure roller 32 against the biasing force of the spring 230, and subsequently rotates in the direction 802 toward the pressure roller 32 due to the biasing force of the spring 230 to abut against the stopper 310. Thus, an impact can be applied to the detachment claw 220 to dust the detachment claw 220. By clearing away paper powder and residual toner sticking to the detachment claw 220 in this manner, the effect of removing dirt on the detachment claw 220 of the paper detachment member 200 is improved.

Third Embodiment

Figure 8A:
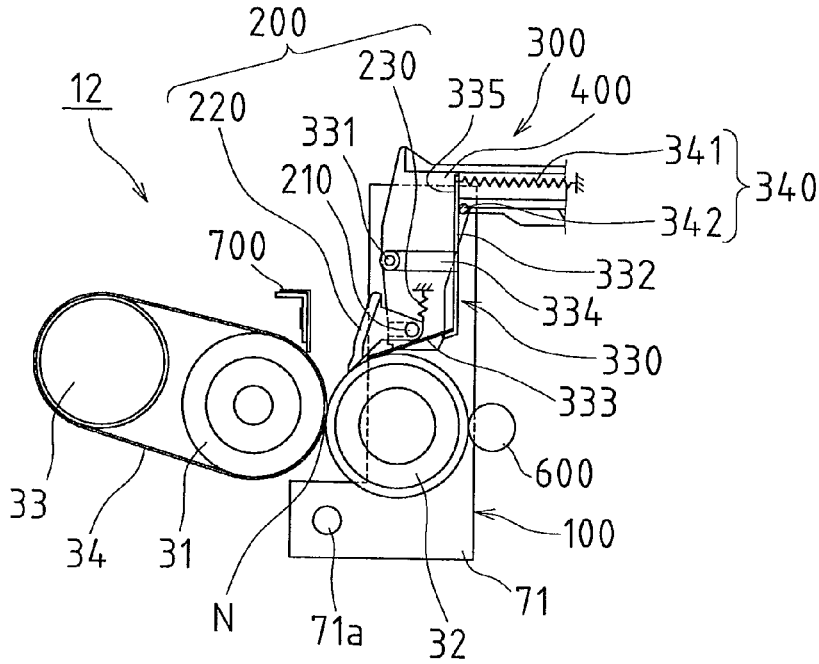
FIGS. 8A and 8B are diagrams for explaining a dirt removing operation of the paper detachment member 200 of the fixing apparatus 12 according to a third embodiment of the present invention.
Figure 8B:
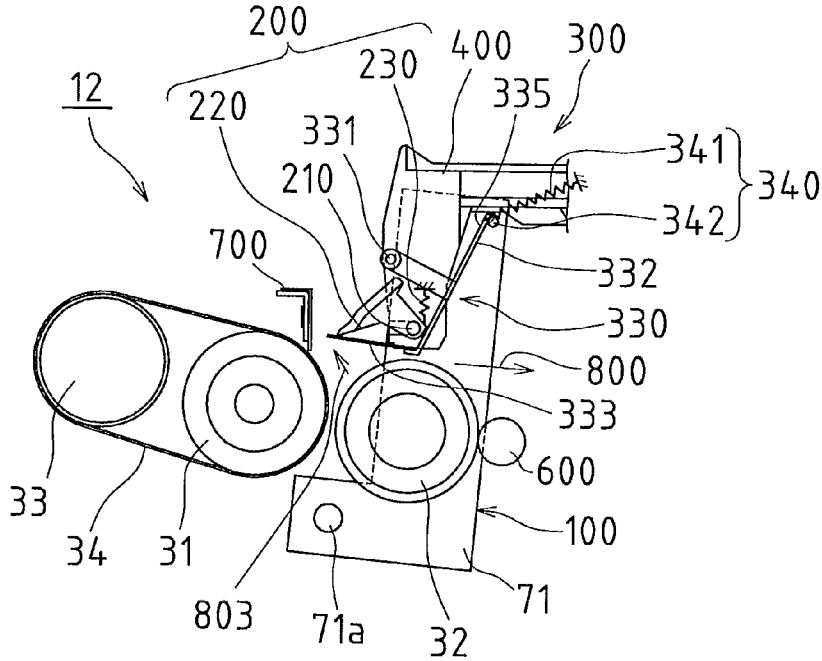

FIGS. 8A and 8B are diagrams for explaining a dirt removing operation of the paper detachment member 200 of the fixing apparatus 12 according to a third embodiment of the present invention.

Referring to FIGS. 8A and 8B, a feature of the present embodiment is that when the detachment claw 220 of the paper detachment member 200 is separated from the pressure roller 32 in conjunction with the above-described pressure cancellation operation of the pressure cancellation unit 100, a leading edge portion of a cleaning member 330 is brought into contact with the surface of a leading edge portion of the detachment claw 220, thereby scraping off paper powder and residual toner sticking to the surface of the leading edge portion of the detachment claw 220 by the cleaning member 330.

The cleaning member 330 includes a cleaning member main body 332 that is rotatably supported on a shaft 331 in directions toward and away from the detachment claw 220, and a spatula 333 protruding from a leading edge portion of this cleaning member main body 332 toward the detachment claw 220.

The cleaning member main body 332 is a plate-like member whose leading edge portion is bent toward the detachment claw 220, and is supported on the shaft 331, which serves as a rotation supporting point of the cleaning member main body 332, via arm portions 334 vertically extending from opposite central side portions of the cleaning member main body 332. It should be noted that end portions of the shaft 331 serving as the rotation supporting point of the cleaning member main body 332 are axially supported on the paper guide 400. This shaft 331 is parallel to the shaft 71*a*, which serves as the rotation supporting point of the moving frames 71, and the shaft 210, which serves as the rotation supporting point of the detachment claw 220.

The spatula 333 is made of a light metal such as stainless steel (SUS) and is fixed to the bent portion of the cleaning member main body 332 described above.

The separation mechanism 300 includes, in addition to the above-described cleaning member 330, a contact mechanism unit 340 for bringing a leading edge portion of the spatula 333 of the cleaning member 330 into contact with the leading edge portion of the detachment claw 220, by rotating a base end portion 335 of the cleaning member main body 332 in a direction away from the detachment claw 220 so that the leading edge portion of the spatula 333 of the cleaning member 330 abuts against the detachment claw 220 and thereby rotating the detachment claw 220 in a direction 803 away from the pressure roller 32 against the biasing force of the compression spring 230, when the pressure applied state in which the pressure roller 32 is pressed against the hot roller 31 is cancelled by the pressure cancellation operation of the pressure cancellation unit 100 (when the pressure roller 32 is separated from the fixing belt 34 as the moving frames 71 rotate on the shaft 71*a* in the direction 800 away from the hot roller, and the pressure exerted on the hot roller 31 by the pressure roller 32 is removed).

The contact mechanism unit 340 is configured of a tension spring 341 that causes the base end portion 335 of the cleaning member main body 332 to rotate in the direction away from the detachment claw 220 so that the leading edge portion of the spatula 333 abuts against the detachment claw 220, and an abutment shaft 342 that is provided so as to protrude from the moving frame 71 toward the cleaning member 330 and that abuts against the cleaning member main body 332 from a direction in which the abutment shaft 342 pushes the cleaning member main body toward the detachment claw 220 (the rear side) when the hot roller 31 and the pressure roller 32 are pressed against each other with the fixing belt 34 sandwiched between them.

Operation

In the present fixing apparatus 12, when the hot roller 31 and the pressure roller 32 are pressed against each other with the fixing belt 34 sandwiched between them, as shown in FIG. 8A, the detachment claw 220 of the paper detachment member 200 abuts against the outer circumferential face of the pressure roller 32. From this state, as shown in FIG. 8B, if the moving frames 71 of the pressure cancellation unit 100 are rotated on the shaft 71*a* in the direction 800 away from the hot roller 31 so that the pressure roller 32 is separated from the fixing belt 34 and the pressure exerted on the hot roller 31 by the pressure roller 32 is removed, the detachment claw 220 of the paper detachment member 200 is separated from the pressure roller 32 in conjunction with this rotation.

At this time, the base end portion 335 of the cleaning member main body 332 rotates on the shaft 331 in the direction away from the detachment claw 220 so that the leading edge portion of the spatula 333 of the cleaning member main body 332 abuts against the detachment claw 220. Accordingly, the detachment claw 220 rotates in the direction 803 away from the pressure roller 32 against the biasing force of the compression spring 230. Consequently, the leading edge portion of the spatula 333 of the cleaning member 330 comes into contact with the leading edge portion of the detachment claw 220. FIG. 8B shows this state.

More specifically, when the moving frames 71 are rotated on the shaft 71*a* in the direction 800 away from the hot roller 31 (the fixing belt 34) during the pressure cancellation operation of the pressure cancellation unit 100, the abutment shaft 342 begins to be temporarily separated from the cleaning member main body 332. Thus, the cleaning member main body 332 is released from the pressure (abutting force) of the abutment shaft 342. Then, the base end portion 335 of the cleaning member main body 332 rotates on the shaft 331 in the direction away from the detachment claw 220 due to the tensile force of the tension spring 341 so that the leading edge portion of the spatula 333 abuts against the detachment claw 220. When the leading edge portion of the spatula 333 abuts against the detachment claw 220, the detachment claw 220 begins to rotate on the shaft 210 in the direction 803 away from the pressure roller 32 against the biasing force of the compression spring 230. After that, the leading edge portion of the spatula 333 comes into contact with the leading edge portion of the detachment claw 220. At this point in time, the cleaning member main body 332 abuts against the abutment shaft 342 again, and thus, the rotation of the cleaning member main body 332 is stopped.

Effects

According to the present embodiment, the same effect as (3) of the first embodiment can be obtained, and also the following effect can be obtained.

When the pressure applied state in which the pressure roller 32 is pressed against the hot roller 31 is cancelled by the pressure cancellation operation of the pressure cancellation unit 100, the base end portion 335 of the cleaning member main body 332 is rotated in the direction away from the detachment claw 220 so that the leading edge portion of the spatula 333 of the cleaning member 330 abuts against the detachment claw 220, the detachment claw 220 is thereby rotated in the direction 803 away from the pressure roller 32 against the biasing force of the compression spring 230, and thus, the leading edge portion of the spatula 333 of the cleaning member 330 comes into contact with the leading edge portion of the detachment claw 220. Accordingly, dirt on the surface of the leading edge portion of the detachment claw 220 can be scraped off. As a result, the effect of removing dirt on the detachment claw 220 is improved even more.

It should be noted that the present invention is not limited to the foregoing embodiments.

In the foregoing embodiments, an example in which the fixing member is configured of the hot roller 31, the hot assist roller 33, and the fixing belt 34, and the pressure member is configured of the pressure roller 32, is described. However, the present invention is not limited to such a configuration. The fixing member may be configured of the hot roller 31, and the pressure member may be configured of the pressure roller 32 paired with the hot roller 31. Even in such a case, the object of the present invention can be sufficiently achieved.

Various other design changes and modifications may be made within the scope of claims as appended to the present specification.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. A fixing apparatus comprising:

a fixing member;

a pressure member for pressing against the fixing member so as to form a nip region between the pressure member and the fixing member;

a pressure cancellation unit for pressing the pressure member against the fixing member and for cancelling the state in which the pressure member is pressed against the fixing member;

a paper detachment member for detaching paper held between the fixing member and the pressure member in the nip region from the pressure member; and a separation mechanism for cleaning the paper detachment member by separating the paper detachment member from the pressure member in conjunction with a pressure cancellation operation of the pressure cancellation unit.

2. The fixing apparatus according to claim 1, wherein the paper detachment member comprises a detachment claw that is rotatably supported on an axis in directions toward and away from the pressure member, the separation mechanism comprises a stopper that regulates a range of rotation of the detachment claw in the direction toward the pressure member, and the stopper is disposed in a position where the stopper forms a separation space between the detachment claw and the pressure member when the state in which the pressure member is pressed against the fixing member is cancelled by the pressure cancellation operation of the pressure cancellation unit.

3. The fixing apparatus according to claim 1, wherein the paper detachment member comprises:

a detachment claw that is rotatably supported on a first axis in directions toward and away from the pressure member, and a spring that biases the detachment claw toward the pressure member;

the separation mechanism comprises:

a stopper that regulates a range of rotation of the detachment claw in the direction toward the pressure member, and an abutment mechanism unit for rotating the detachment claw in the direction away from the pressure member against a biasing force of the spring and subsequently rotating the detachment claw in the direction toward the pressure member by means of the biasing force of the spring, thereby causing the detachment claw to abut against the stopper, when the state in which the pressure member is pressed against the fixing member is cancelled by the pressure cancellation operation of the pressure cancellation unit; and the stopper is disposed in a position where the stopper forms a separation space between the detachment claw and the pressure member when the state in which the pressure member is pressed against the fixing member is cancelled by the pressure cancellation operation of the pressure cancellation unit.

4. The fixing apparatus according to claim 3, wherein the pressure cancellation unit comprises a moving frame that supports the pressure member and that rotates on a second axis parallel to the first axis in directions toward and away from the fixing member, the abutment mechanism unit comprises an abutment member that is provided so as to protrude from the moving frame toward the detachment claw and that abuts against the detachment claw from a downstream side of a paper transport direction when the fixing member and the pressure member are pressed against each other, and when the moving frame is rotated in the direction away from the fixing member during the pressure cancellation operation of the pressure cancellation unit, the detachment claw begins to rotate, due to an abutting force of the abutment member, in the direction away from the pressure member against the biasing force of the spring, and when the detachment claw is pushed up over the abutment member, the detachment claw is released from the abutting force of the abutment member and begins to rotate in the direction toward the pressure member due to the biasing force of the spring, and thus abuts against the stopper.

5. The fixing apparatus according to claim 1, wherein the paper detachment member comprises:

a detachment claw that is rotatably supported on a first axis in directions toward and away from the pressure member, and a compression spring that biases the detachment claw toward the pressure member; and the separation mechanism comprises:

a cleaning member comprising a cleaning member main body that is rotatably supported on a second axis parallel to the first axis in directions toward and away from the detachment claw, and a spatula protruding from a leading edge portion of the cleaning member main body toward the detachment claw, and a contact mechanism unit for bringing a leading edge portion of the spatula of the cleaning member into contact with a leading edge portion of the detachment claw, by rotating a base end portion of the cleaning member main body in a direction away from the detachment claw so that the leading edge portion of the spatula of the cleaning member abuts against the detachment claw and thereby rotating the detachment claw in the direction away from the pressure member against a biasing force of the compression spring, when the state in which the pressure member is pressed against the fixing member is cancelled by the pressure cancellation operation of the pressure cancellation unit.

6. The fixing apparatus according to claim 5, wherein the pressure cancellation unit comprises:

a moving frame that supports the pressure member and that rotates on a third axis parallel to the first and the second axes in directions toward and away from the fixing member;

the contact mechanism unit comprises:

a tension spring that causes the base end portion of the cleaning member main body to rotate in the direction away from the detachment claw so that the leading edge portion of the spatula abuts against the detachment claw, and an abutment member that is provided so as to protrude from the moving frame toward the cleaning member and that abuts against the cleaning member main body from a direction in which the abutment member pushes the cleaning member main body toward the detachment claw when the fixing member and the pressure member are pressed against each other; and when the moving frame is rotated in the direction away from the fixing member during the pressure cancellation operation of the pressure cancellation unit, the abutment member begins to be temporarily separated from the cleaning member main body, and with this separation, the base end portion of the cleaning member main body is released from an abutting force of the abutment member and rotates in the direction away from the detachment claw due to a tensile force of the tension spring so that the leading edge portion of the spatula abuts against the detachment claw, and when the leading edge portion of the spatula abuts against the detachment claw, the detachment claw begins to rotate, due to an abutting force of the spatula, in the direction away from the pressure member against the biasing force of the compression spring, and thereafter, at a point in time when the leading edge portion of the spatula comes into contact with the leading edge portion of the detachment claw, the cleaning member main body abuts against the abutment member again.

7. The fixing apparatus according to claim 1, wherein the pressure member comprises a cleaning member for collecting toner on the pressure member.

8. An image forming apparatus comprising the fixing apparatus according to claim 1.

* * * * *